US006038816A

United States Patent [19]

Park

[11] Patent Number: 6,038,816

[45] Date of Patent: Mar. 21, 2000

[54] BLINDER

[75] Inventor: Sun-Eun Park, Daegoo, Rep. of Korea

[73] Assignee: Hansung Special Glass Co., Ltd., Kyungsangbuk-do, Rep. of Korea

[21] Appl. No.: 09/351,470

[22] Filed: Jul. 12, 1999

[30] Foreign Application Priority Data

Jun. 7, 1999 [KR] Rep. of Korea ..... 99-10011 U

[51] Int. Cl.[7] ..... E06B 7/086

[52] U.S. Cl. ..... 49/86.1; 49/64; 49/74.1

[58] Field of Search ..... 49/74.1, 82.1, 49/86.1, 61, 62, 63, 64; 160/176.1 R, 176.1 P, 177 R

[56] References Cited

U.S. PATENT DOCUMENTS

| | | | |
|---|---|---|---|
| 2,029,143 | 1/1936 | Wicks | 160/176.1 P X |
| 2,149,481 | 3/1939 | Bosch et al. | 160/176.1 P X |
| 4,554,762 | 11/1985 | Anderson | 49/64 X |
| 4,602,456 | 7/1986 | Tatro | 49/74.1 |
| 4,934,438 | 6/1990 | Yuhas et al. | 49/82.1 X |
| 5,600,920 | 2/1997 | Roy | 49/64 |
| 5,909,093 | 6/1999 | van Dinteren et al. | 49/25 X |

*Primary Examiner*—Jerry Redman

*Attorney, Agent, or Firm*—Webb Ziesenheim Logsdon Orkin & Hanson, P.C.

[57] ABSTRACT

A blinder includes main frames spaced apart from each other with a predetermined distance. Each of the main frames has an internal empty space. Support frames are perpendicularly interposed between the main frames to support the main frames. A plurality of shutting members is arranged parallel to each other between the main frames inside the support frames. A motor is fixed to each of the main frames within the internal empty space. A driving shaft is movably connected to the motor within the internal empty space. A plurality of rotating members is fixed to the driving shaft to rotate upon receipt of a rotational power from the motor via the driving shaft. A pulling member is held between each of the opposite rotating members to keep each of the shutting members at its proper place. The pulling member is partially wound around the opposite rotating members in such a manner as to move with the rotation of the rotating member and control an opening or closing operation of the shutting member.

6 Claims, 7 Drawing Sheets

BLINDER

BACKGROUND OF THE INVENTION (a) Field of the Invention

The present invention relates to a blinder and, more particularly, to a blinder which can be automatically and remotely controlled to be in an opening or closing state in any installation place.

(b) Description of the Related Art

Usually, blinders are installed over windows to shade off the sunlight or shield the room from the outside. Such a blinder has a main frame and a plurality of shutting members arranged below the main frame. The shutting members are connected to each other via ropes and belts. An operating rod is connected to the rope and the belt to manually control opening or closing angles of the shutting members. When the operating rod is manually operated to be rotated in a clockwise or anti-clockwise direction, the rotational power of the operating rod is transmitted to the shutting members via the rope and the belt to thereby control either angles of the shutting members.

However, in the blinders, the user suffers inconvenience in that they should be manually operated one by one. In particular, when such blinders are employed for use in large-sized or giant buildings, the inconvenience becomes deeper. Furthermore, in narrow or curved places, the blinder control becomes extremely difficult.

SUMMARY OF THE INVENTION

It is an object of the present invention to provide a blinder which can be automatically and remotely controlled to be in an opening or closing state in any installation place.

This and other objects may be achieved by a blinder including main frames spaced apart from each other with a predetermined distance. Each of the main frames has an internal empty space. Support frames are perpendicularly interposed between the main frames to support the main frames. A plurality of shutting members is arranged parallel to each other between the main frames inside the support frames. A motor is fixed to each of the main frames within the internal empty space. A driving shaft is movably connected to the motor within the internal empty space. A plurality of rotating members is fixed to the driving shaft to rotate upon receipt of a rotational power from the motor via the driving shaft. A pulling member is held between each of the opposite rotating members to keep each of the shutting members at its proper place. The pulling member is partially wound around the opposite rotating members in such a manner as to move with the rotation of the rotating member and control an opening or closing operation of the shutting member.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
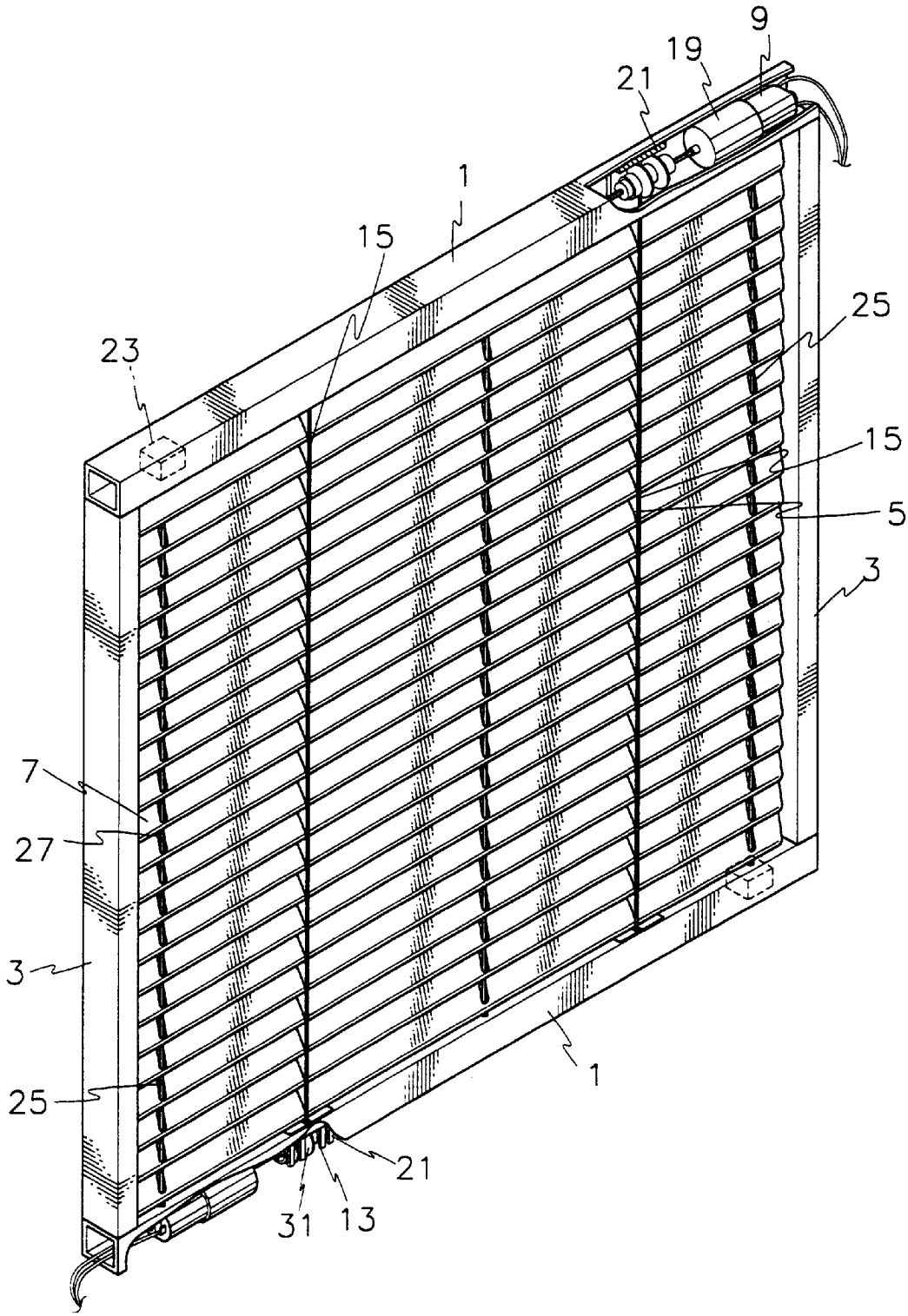
FIG. 1 is a fragmentary sectional perspective view of a blinder according to a preferred embodiment of the present invention.
Figure 2:
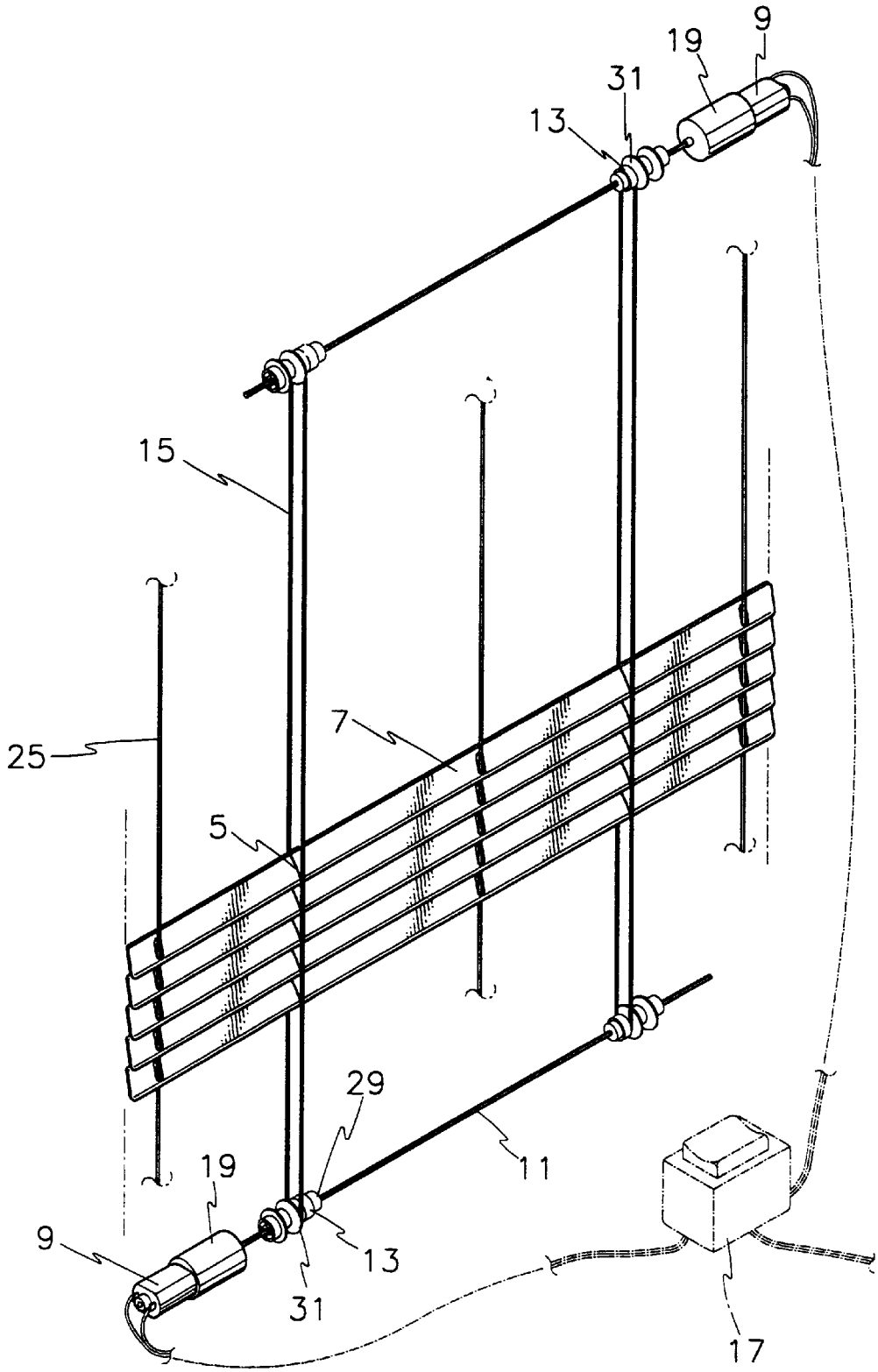
FIG. 2 is an exploded perspective view of main components of the blinder shown in FIG. 1.
Figure 3:
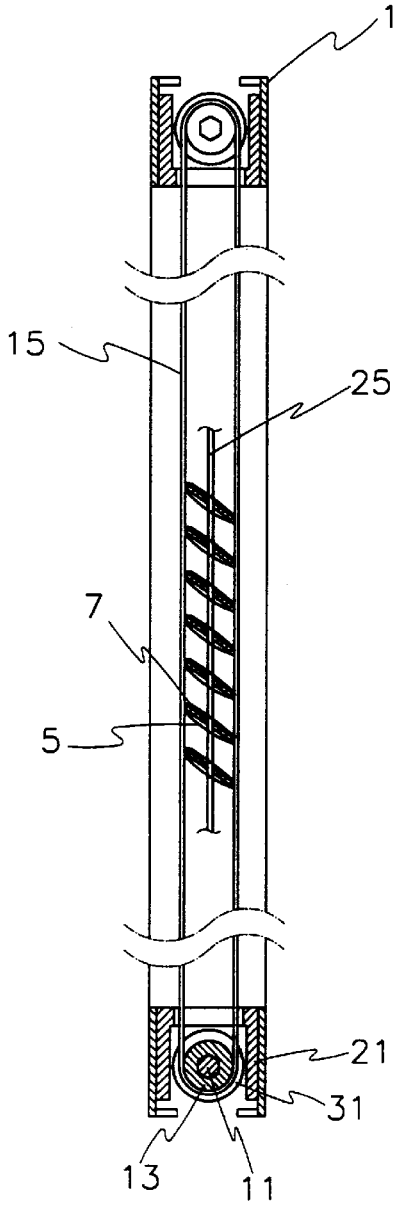
FIG. 3 is a side elevation view of the blinder shown in FIG. 1.
Figure 4:
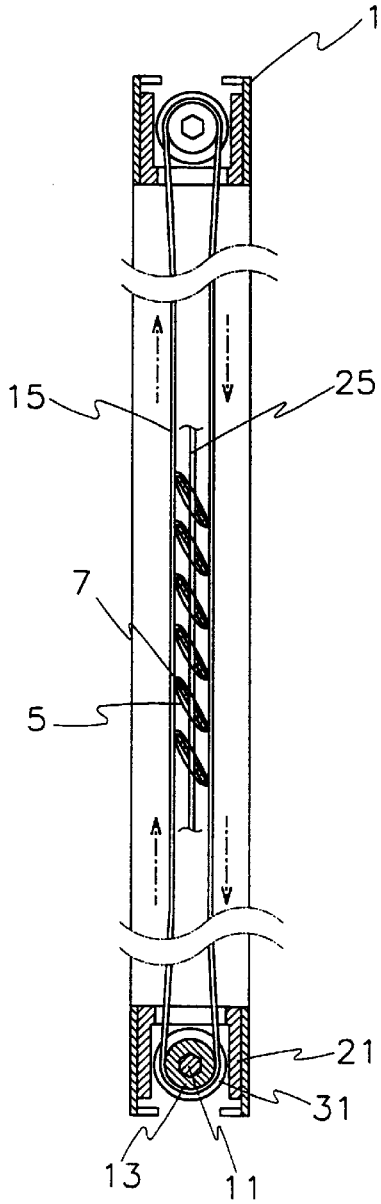
FIG. 4 is a side elevation view of the blinder shown in FIG. 1 illustrating operation of a shutting angle controlling mechanism.

FIGS. 1 to 4 are views illustrating a blinder according to a preferred embodiment of the present invention. As shown in the figures, the blinder includes main frames 1 spaced apart from each other with a predetermined distance, and support frames 3 perpendicularly interposed between the main frames 1 to support them. Each of the main frames 1 has an internal empty space. A plurality of shutting members 7 is arranged parallel to each other between the main frames 1 inside the support frames 3.

A driving mechanism is mounted within each of the main frames 1. The driving mechanism includes a motor 9 fixed to an inner side of the main frame 1, a driving shaft 11 movably connected to a motor 9, and a plurality of rotating members 13 fixed to the driving shaft 11 via corresponding fixtures 29. The rotating members 13 are rotated upon receipt of rotational power from the motor 9 via the driving shaft 11. In order to assist smooth rotational movements of the rotating member 13 within the main frame 1, two or more guide members 21 are fixed to the inner side of the main frame 1 and suitable numbers of rolling members 31 are formed around the rotating member 13 to move along the corresponding guide members 21.

The motor 9 is electrically connected to an external control switch 17 by wire or a wireless system. A speed reducer 19 is connected to the motor 9 to prevent excessive operation of the motor 9.

A pulling member 15 is held between each of the opposite rotating members 13 and keeps each of the shutting members at its proper place via a corresponding connecting member 5. The pulling member 15 is partially wound around the opposite rotating members 13 in such a tight manner as to move with the rotation of the rotating member 13. In this structure, when the pulling member 15 moves up and down, the shutting members are alternately in an opening state or a closing state.

Suitable numbers of guide ropes 25 are held between the main frames 1 through the shutting members 7 to guide rotating movement of the shutting members 7. Each of the shutting members 7 is formed with a breakthrough hole 27 for allowing passage of the guide rope 25. Each of the guide ropes 25 is fixed to the main frame 1 by using a bracket 23.

In operation, when the driving shaft 11 is rotated in a clockwise direction and the rotational power of the driving shaft 11 is transmitted to the rotating members 13, the rotating members 13 is also rotated in a clockwise direction by the guidance of the rolling members 31 and the guide members 21. At this time, the pulling members 15 held between the opposite rotating members 13 are elevated at a predetermined length to thereby rotate the shutting member 7 in a clockwise direction at a predetermined angle. The smooth rotation of the shutting member 7 can be ensured by the guidance of the guide rope 25.

On the contrary, when the driving shaft 11 is rotated in an anti-clockwise direction by conversely operating the control switch 17, the aforementioned operational procedure is performed to thereby rotate the shutting members 7 in an anti-clockwise direction.

This structure makes it possible that the inventive blinder can be automatically and remotely controlled to be in an opening or closing state even in narrow or curved places. In particular, the blinder can be conveniently employed for remote-controlling use in giant buildings.

Figure 5:
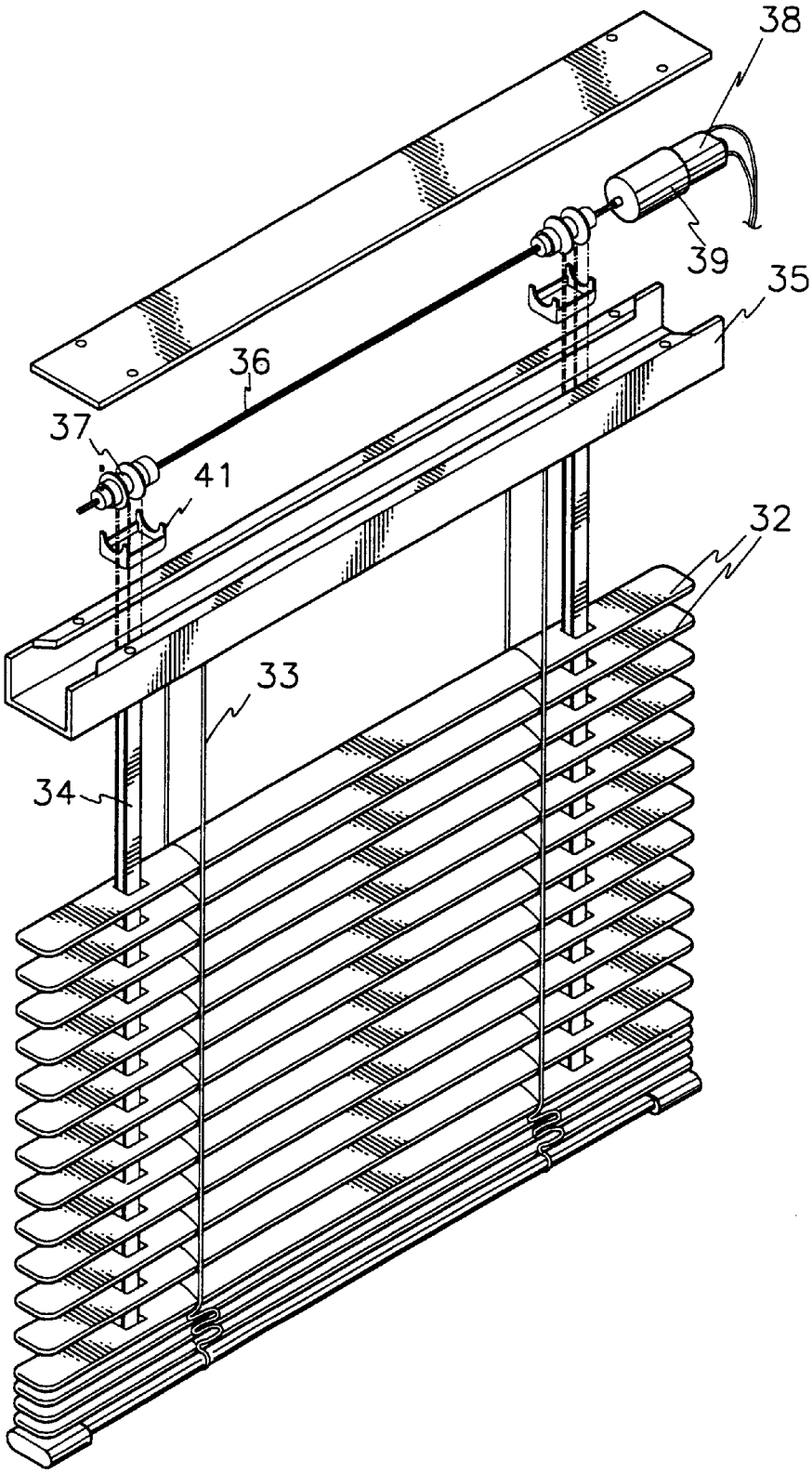
FIG. 5 is an exploded perspective view of a blinder according to a second preferred embodiment of the present invention.
Figure 6:
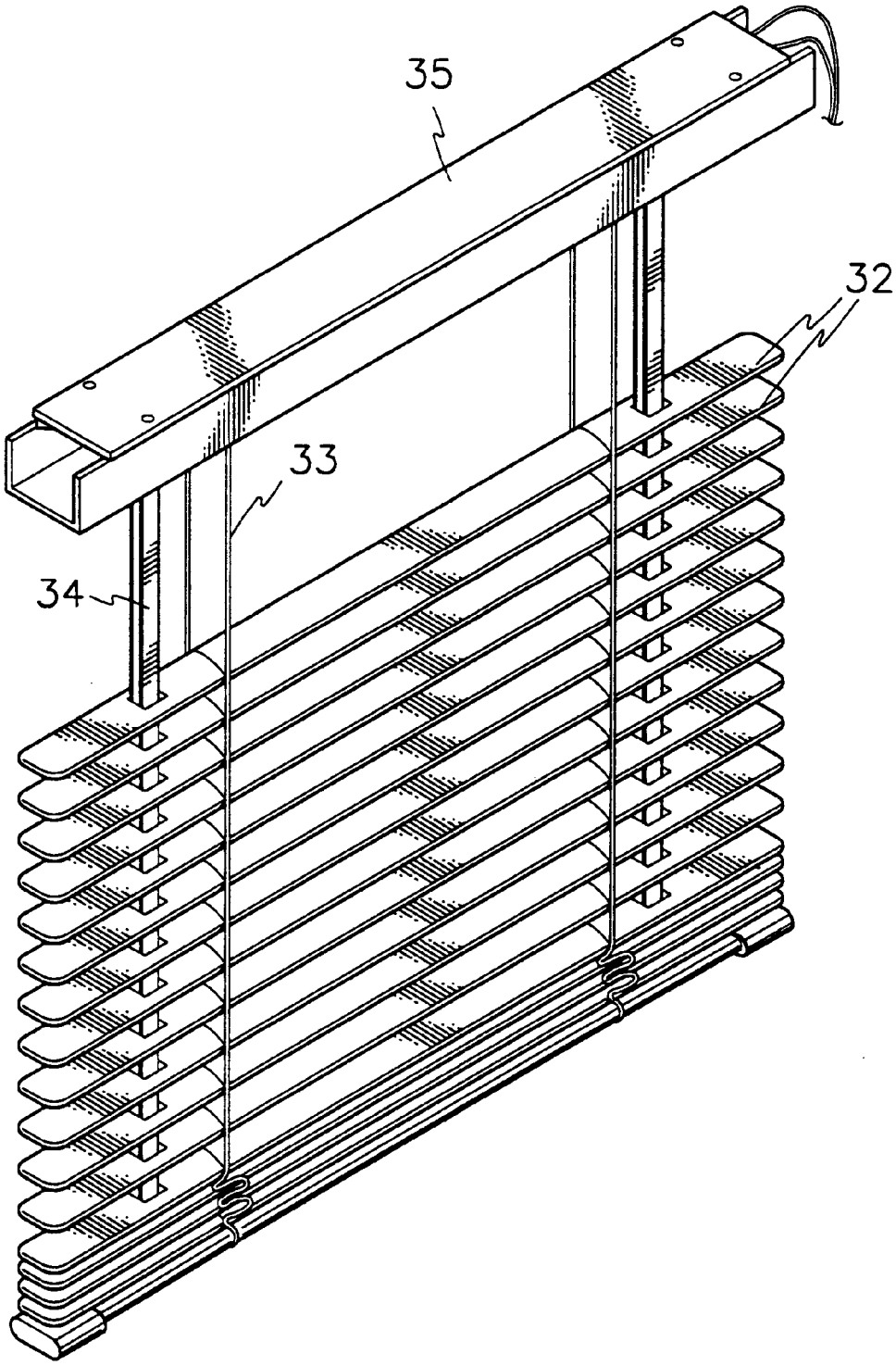
FIG. 6 is a combinatorial perspective view of the blinder shown in FIG. 5.
Figure 7:
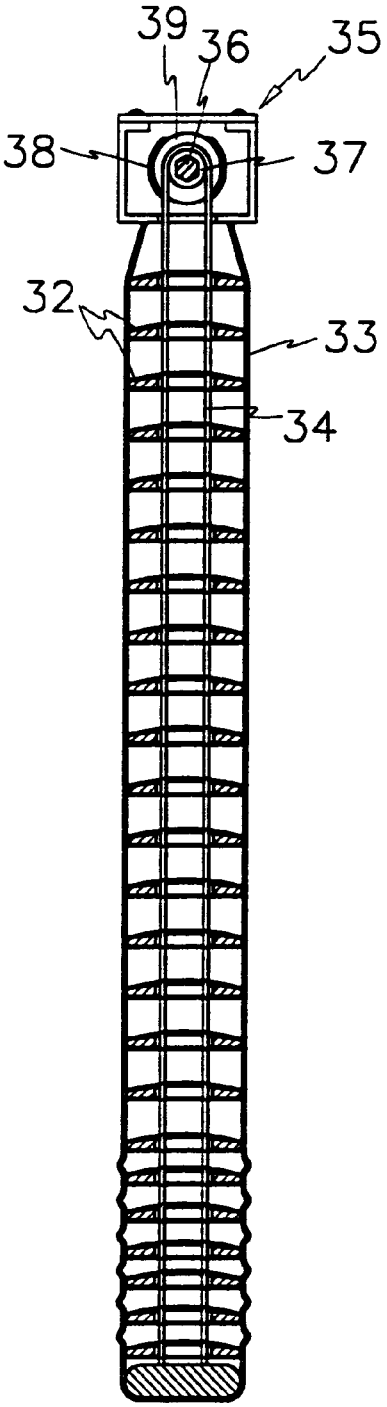
FIG. 7 is a side view of the blinder shown in FIG. 5 illustrating an operating state of the blinder.
Figure 8:
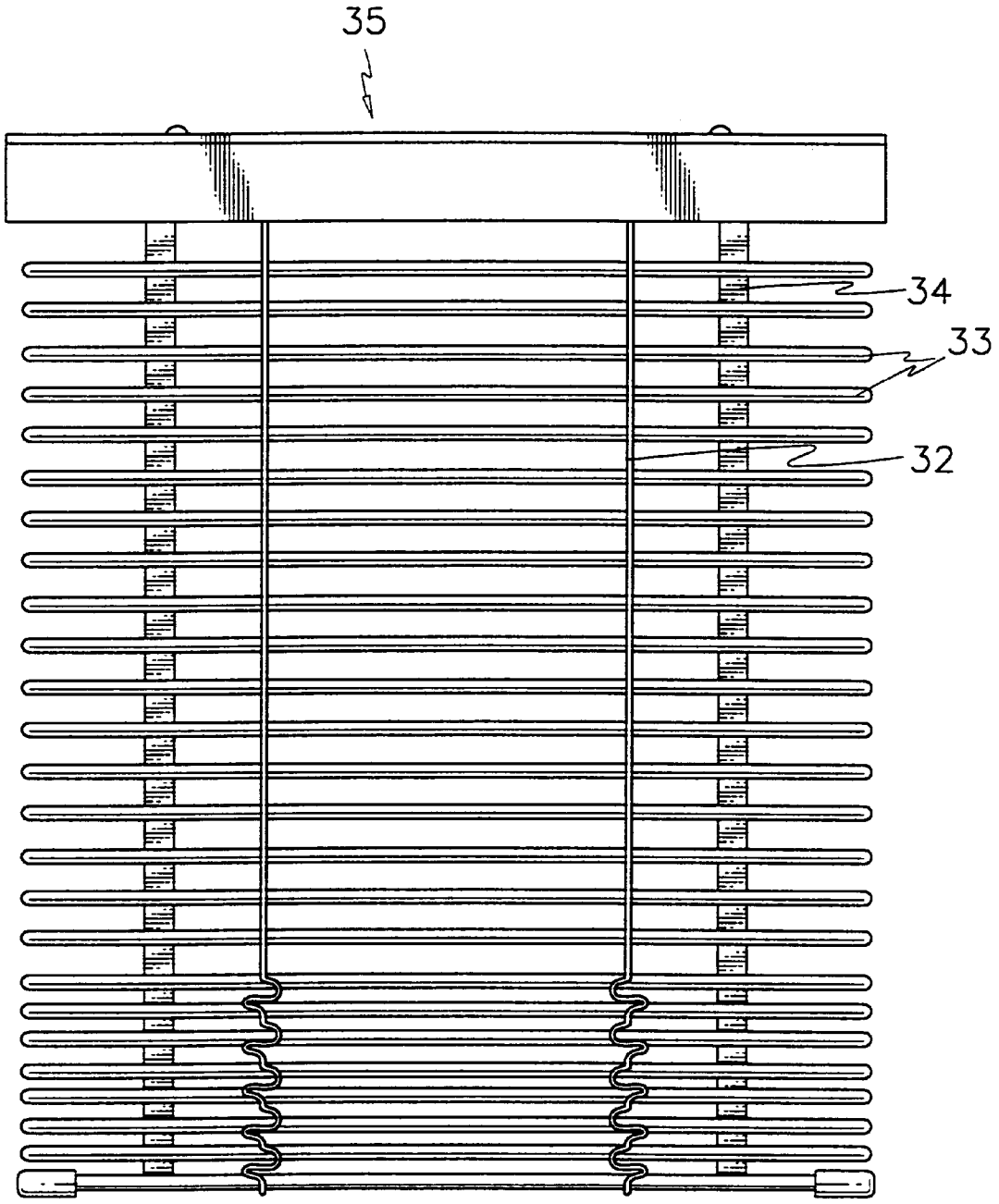
FIG. 8 is a front view of the blinder shown in FIG. 7.

FIGS. 5 to 8 are views illustrating a blinder according to a second preferred embodiment of the present invention. As shown in the figures, the blinder includes a main frame 35, a plurality of shutting members 32 connected to the main frame 35 via a pulling rope 33 and a pulling belt 34, a driving shaft 36 rotatably fixed into the main frame 35 via a bracket 41, and a rotating roller 37 fixed around the driving shaft 36. The pulling belt 34 is tightly held around the rotating roller 37 while keeping the shutting members 32 at their proper places together with the pulling rope 33. The driving shaft 36 is connected to a speed reducer 39 and a motor 38. The motor 38 may be electrically connected to an external switch (not shown) or remotely controlled.

In this structure, when the driving shaft 36 is rotated upon receipt of driving power from the motor 38, the rotating roller 37 fixed onto the driving shaft 36 is also rotated to thereby pull up or down the pulling belt 34. In this way, the shutting members 32 can be automatically in an opening or closing state.

The motor 38 is structured such that the driving shaft 36 connected to the motor 38 can be bi-directionally rotated and arbitrarily stopped to locate the shutting members 32 at a desired position. The advantageous effects related to the blinder according to the first preferred embodiment can be also obtained in this preferred embodiment While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A blinder comprising:

main frames spaced apart from each other with a predetermined distance, each of the main frames having an internal empty space;

support frames perpendicularly interposed between the main frames to support the main frames;

a plurality of shutting members arranged parallel to each other between the main frames inside the support frames;

a motor fixed to each of the main frames, the motor being placed within the internal empty space of the main frame;

a driving shaft movably connected to the motor, the driving shaft being placed within the internal empty space of the main frame;

a plurality of rotating members fixed to each of the driving shafts to rotate upon receipt of a rotational power from the motors via the driving shafts, each of the rotating members having holes; and a pulling member held between each of the opposite rotating members to keep each of the shutting members at its proper place, the pulling member being partially wound around the opposite rotating members in such a tight manner as to move with the rotation of the rotating member to thereby control an opening or closing operation of the shutting member.

2. The blinder of claim 1 further comprising an external control switch electrically connected to the motor by wire or a wireless system.

3. The blinder of claim 1 further comprising a plurality of guide members disposed in the internal empty space of the main frame to guide a rotational movement of the rotating member.

4. The blinder of claim 1 further comprising a plurality of guide ropes held between the main frames, each of the guide holes passing through the holes of the shutting members to guide a rotational movement of the shutting members.

5. The blinder of claim 1 wherein the rotating member is provided with a plurality of rolling members for inducing a smooth rotation of the rotating member.

6. The blinder of claim 3 wherein the rotating member is provided with a plurality of rolling members, the rolling members moving along the guide members.

* * * * *